US009950900B2

(12) United States Patent
Altenburger

(10) Patent No.: US 9,950,900 B2
(45) Date of Patent: Apr. 24, 2018

(54) LIFT SYSTEM

(71) Applicants: THYSSENKRUPP ELEVATOR AG, Essen (DE); THYSSENKRUPP AG, Essen (DE)

(72) Inventor: Bernd Altenburger, Neuhausen (DE)

(73) Assignees: THYSSENKRUPP ELEVATOR AG, Essen (DE); THYSSENKRUPP AG, Essen (DE)

( * ) Notice: Subject to any disclaimer, the term of this patent is extended or adjusted under 35 U.S.C. 154(b) by 95 days.

(21) Appl. No.: 14/852,493

(22) Filed: Sep. 12, 2015

(65) Prior Publication Data

US 2016/0083223 A1 Mar. 24, 2016

(30) Foreign Application Priority Data

Sep. 18, 2014 (DE) ..... 10 2014 113 514

(51) Int. Cl.
*B66B 7/06* (2006.01)

(52) U.S. Cl.
CPC ..... *B66B 7/068* (2013.01); *B66B 7/064* (2013.01)

(58) Field of Classification Search
CPC ..... B66B 7/068; B66B 7/064
See application file for complete search history.

(56) References Cited

U.S. PATENT DOCUMENTS 3,430,733 A * 3/1969 Smith ..... B66B 7/064 138/128
3,768,596 A * 10/1973 Solymos ..... F16G 13/00 187/254
5,074,384 A * 12/1991 Nakai ..... B66B 7/068 187/289
6,333,865 B1 * 12/2001 Yumura ..... B66B 7/064 187/295
2005/0217940 A1 * 10/2005 Mori ..... B66B 7/068 187/226
2006/0163010 A1 * 7/2006 Ogava ..... B66B 7/068 187/401
2007/0131489 A1 * 6/2007 Stalder ..... B66B 7/068 187/404
2008/0093177 A1 * 4/2008 Fargo ..... B66B 7/068 187/249
2012/0067674 A1 3/2012 Legeret
(Continued)

FOREIGN PATENT DOCUMENTS

CN 102320505 A 1/2012
DE 10305275 A 8/2004
(Continued)

OTHER PUBLICATIONS

European Search Report for European Patent App. No. EP15182276.4 (dated Feb. 2016).
(Continued)

*Primary Examiner* — Michael A Riegelman
(74) *Attorney, Agent, or Firm* — thyssenkrupp North America, Inc.

(57) ABSTRACT

The invention concerns a lift system with at least one lift car able to ride in a lift shaft, while a travelling cable is provided, having a first end at the lift car side and a second end at the shaft side, wherein the weight force of the travelling cable is at least partially channelled into a traction means or balancing means engaging with the lift car.

14 Claims, 6 Drawing Sheets

(56) References Cited

U.S. PATENT DOCUMENTS

2012/0325592 A1* 12/2012 Bloch ..... B66B 7/068 187/414
2013/0015022 A1* 1/2013 Sonnenmoser ..... B66B 7/064 187/394
2013/0048432 A1* 2/2013 Alasentie ..... B66B 7/068 187/251
2014/0110194 A1* 4/2014 Zhu ..... B66B 7/08 187/254
2014/0224590 A1* 8/2014 Puranen ..... B66B 5/022 187/247
2014/0345978 A1* 11/2014 Alasentie ..... B66B 7/064 187/254
2014/0353091 A1* 12/2014 Fauconnet ..... B66B 7/064 187/413
2015/0122588 A1* 5/2015 Kalliomaki ..... B66B 7/068 187/264
2016/0159612 A1* 6/2016 Watanabe ..... B66B 7/064 187/413
2016/0207738 A1* 7/2016 Altenburger ..... B66B 7/064

FOREIGN PATENT DOCUMENTS

| | | | |
|---|---|---|---|
| GB | 113081 | A | 2/1918 |
| JP | H05078059 | A | 3/1993 |
| JP | 2012184092 | A | 9/2012 |
| WO | 2012034899 | A | 3/2012 |
| WO | 2015043767 | A1 | 4/2015 |

OTHER PUBLICATIONS

English abstract for DE10305275.
English abstract for CN102320505.

* cited by examiner

LIFT SYSTEM

CROSS-REFERENCE TO RELATED APPLICATIONS

This application claims priority to German Patent Application Serial No. DE102014113514.8 filed Sep. 18, 2014, the entire contents of which is hereby incorporated by reference herein.

FIELD

This disclosure relates to a lift system.

BACKGROUND

In traditional lift systems with a lift car, the lift car is led across a traction means, such as at least one traction cable or at least one traction belt, which is led across a driving sheave and deflection rollers and connected to a counterweight. Lift car and counterweight can travel along respective guides in a lift shaft. The lift car is typically configured with guide rollers, which interact with the lift car guide (guide rails). Furthermore, a travelling cable is connected to the lift car. By means of this travelling cable, the lift car is supplied with electric energy, for example. Moreover, data can be exchanged via the travelling cable between the lift car and an external computer or control unit.

The travelling cable is typically secured at one end to one side or the floor of the lift car, and at the other end to or in the lift shaft. Especially for fastening of the travelling cable to a side wall of the lift car (which is preferable for certain designs of a lift system), unequal loading of the lift car occurs on account of the weight force of the travelling cable, especially on the guide rollers.

In order to ensure good riding qualities and good riding comfort, the lift car must be balanced as precisely as possible. Therefore, a balancing weight is provided on the lift car to compensate for this variable loading due to the travelling cable along the length of the shaft. In this way, it is possible to compensate a moment or torque exerted by the travelling cable due to its weight force on the guide rollers of the lift car, so that the loading of the guide rollers can be lessened.

However, such a compensation by means of a balancing weight is only optimal in a particular position of the lift car in the lift shaft, usually the middle of the lift shaft. In the other positions there is still a more or less unequal distribution of forces on the guide rollers. In particular in the uppermost and lowermost position of the lift car in the lift shaft, the greatest loading of the guide rollers occurs.

It is therefore desirable to provide a way to effectively and easily minimize the loads exerted by a travelling cable of a lift car on the lift car or its guide rollers.

SUMMARY

In one aspect of the present disclosure, a lift system is disclosed in which a traveling cable is supported at least partially on the traction means above the lift car. An embodiment of the lift system includes at least one lift car configured to ride in a lift shaft, a traction means coupled to a top of the lift car and configured to support the lift car in the lift shaft, and a traveling cable having a first end disposed at a side of the lift car and coupled to the traction means above the lift car, and a second end disposed at a side of the lift shaft, a weight force of the traveling cable being at least partially supported by the traction means above the lift car.

BRIEF DESCRIPTION OF THE DRAWINGS

The present invention is described in detail below with reference to the attached drawing figures, wherein.

DETAILED DESCRIPTION

Figure 1A:
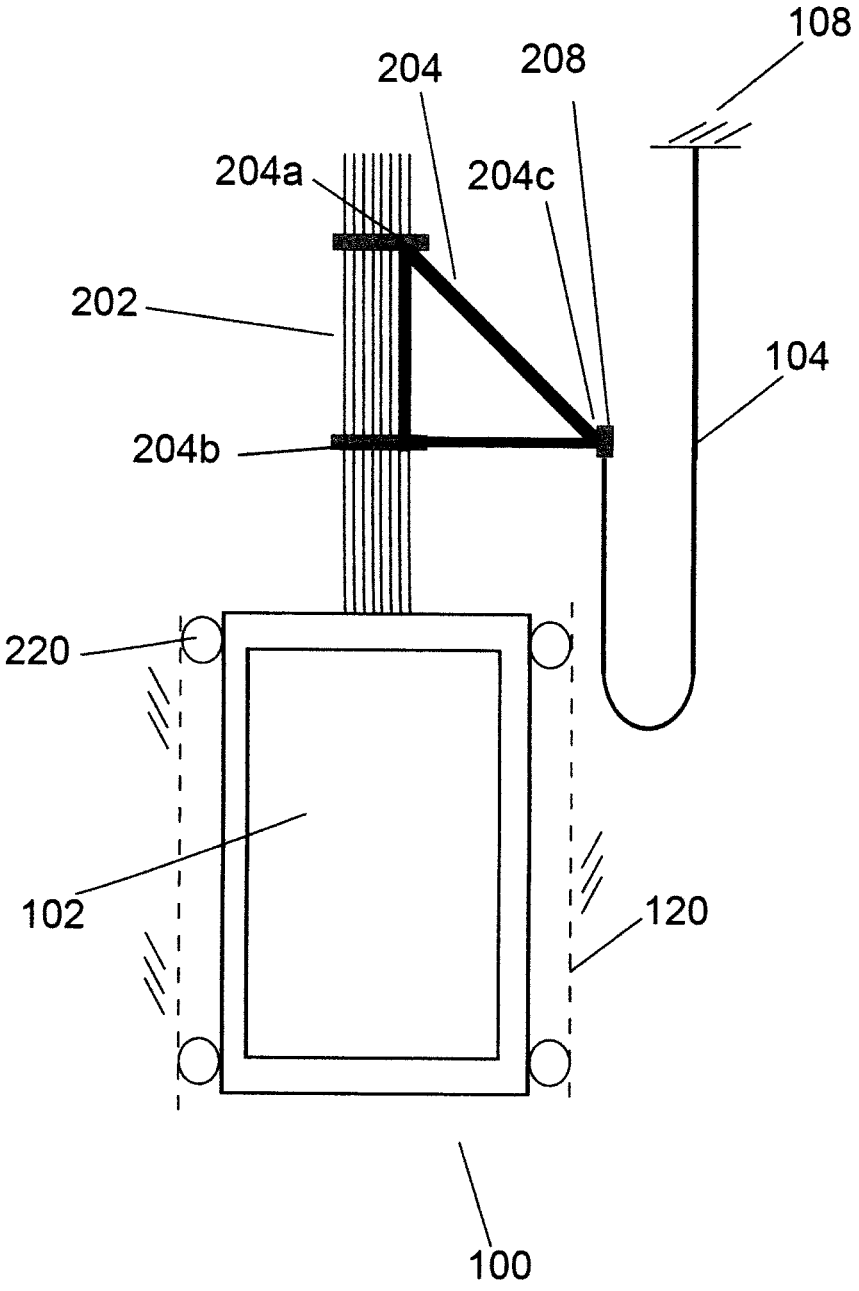
FIG. 1*a* is a schematic side view of an embodiment of a lift system of the present disclosure, wherein a lift car is represented in a first position inside a lift shaft.

A lift system of the present disclosure has at least one lift car able to ride in a lift shaft, while a travelling cable is connected to the lift car, having a first end at the lift car and a second end at the shaft side. According to the invention, the weight force of the travelling cable is at least partially channelled into a traction means engaging with the lift car above the lift car or into a balancing means engaging with the lift car.

The lift system according to the invention especially preferably has two or more, for example three or four lift cars able to ride in a common lift shaft. With the design according to the invention, travelling cables of an upper lift car for example can easily move past a lower lift car.

In an especially advantageous manner, the weight force of the travelling cable is channelled into a traction means, especially a traction cable or traction belt of the lift car. Such a traction means engages in particular centrally on a lift car or its safety frame, so that a reduced torque loading of the lift car by the travelling cable can be assured by channelling the weight force of the travelling cable into this traction means.

Advisedly, a support structure is provided, which is connected to the traction means above the lift car and which carries the travelling cable, which thus channels the weight force of the travelling cable into the traction means.

It is especially preferred to design such a support structure with a balancing weight. In this way, bending or shifting of the traction means with respect to the vertical dimension direction due to the loading of the traction means by the travelling cable can be minimized.

This also further improves the effect of the reduced torque loading.

Preferably the support structure is connected at least at one place to the traction means and at least at one other place it carries the travelling cable. In this context, various rod assemblies or supporting polygons are conceivable as the support structure.

Preferably this support structure is configured as a support triangle, which is connected to the traction means by at least one corner, especially two corners, and which carries or receives the weight force of the travelling cable on at least one other corner. Such support triangles can be easily dimensioned according to the specific loads. Here "connected" means in particular a fixed attachment or also a sliding guide on the traction means.

The support structure according to one preferred embodiment can be mounted in pivoting manner on the lift car, especially on a safety frame of the lift car. By means of such a pivoting bearing, the mounting or installation of the support structure can be easily implemented and performed in a stable and secure manner.

Preferably the travelling cable is fastened to a suspension member, which is designed so that it can move in a vertically movable slide on one side of the lift car, while the suspension member is connected by a connecting mechanism, especially a connecting element, to the support structure. The connecting element can be fashioned in particular as a connecting rope or connecting rod. With this provision, it can be assured that the travelling cable is connected at the side to the lift car, yet at the same time is vertically decoupled from the force of the lift car thanks to the movability of the suspension member based on the movable slide. At the same time, this provision constitutes a horizontal guidance of the travelling cable.

Alternatively, it is possible to provide the travelling cable suspension member at a pivoting lever fashioned on the lift car, this lever being connected by a connecting element, especially a rod or a rope, to the support structure. Also with this design a vertical force decoupling of the travelling cable from the lift car can be achieved.

The invention can be employed in particular for traction means which are led from the lift car across at least one deflection roller to a counterweight. It can also be employed for traction means which [are led] from a counterweight (first end of the traction means) to the lift car, and from this back to the counterweight (second end of the traction means), the traction means being deflected on deflection rollers provided on the lift car. In this embodiment, the traction means forms a loop, while the travelling cable can be connected by a corresponding suspension member to the loop, so that its weight force can be channelled into this loop or the traction means.

According to another preferred embodiment, the weight force of the travelling cable is channelled into a balancing means of the lift car fashioned, for example, as a balance rope. Balance ropes serve in a familiar manner to equalize the weight forces acting by virtue of the traction means itself on the driving sheave of the lift. As a rule, they run between the underside of the lift car and the underside of the counterweight, and are deflected around at least one roller provided in the shaft pit. Advantageously, one of these rollers is configured in the context of a balance rope tensioning device.

Advisedly in this embodiment as well the travelling cable can be secured to a suspension member, which is able to move in a vertically movable slide on one side of the lift car, while the suspension member is advantageously connected by a connecting mechanism, especially a connecting element, such as a connecting rod or a connecting rope, to the balance rope or a support structure provided in the latter.

The invention can be employed especially advantageously in a lift system in which the lift car can move along a guide mechanism (such as guide rails) fashioned in the lift shaft, while the lift car has a number of guide rollers which interact with the guide mechanism. Thanks to the torque reduction provided according to the invention by virtue of channelling the weight force of the travelling cable into a traction means or a balancing means, the loading of the guide rollers is reduced in particular, which at the same time assures an especially comfortable and quiet movement of the lift car along the guide mechanism.

The same benefits in connection with a torque reduction also result in the case of a noncontact guidance of the lift car, such as a magnetic guidance.

Further benefits and embodiments of the invention will emerge from the description and the accompanying drawing.

Of course, the aforementioned features and those yet to be explained can be used not only in the particular indicated combination, but also in other combinations or standing alone, without leaving the scope of the present invention.

The present disclosure is further represented schematically by means of various exemplary embodiments shown in the drawings, which shall be described in further detail below.

Figure 1B:
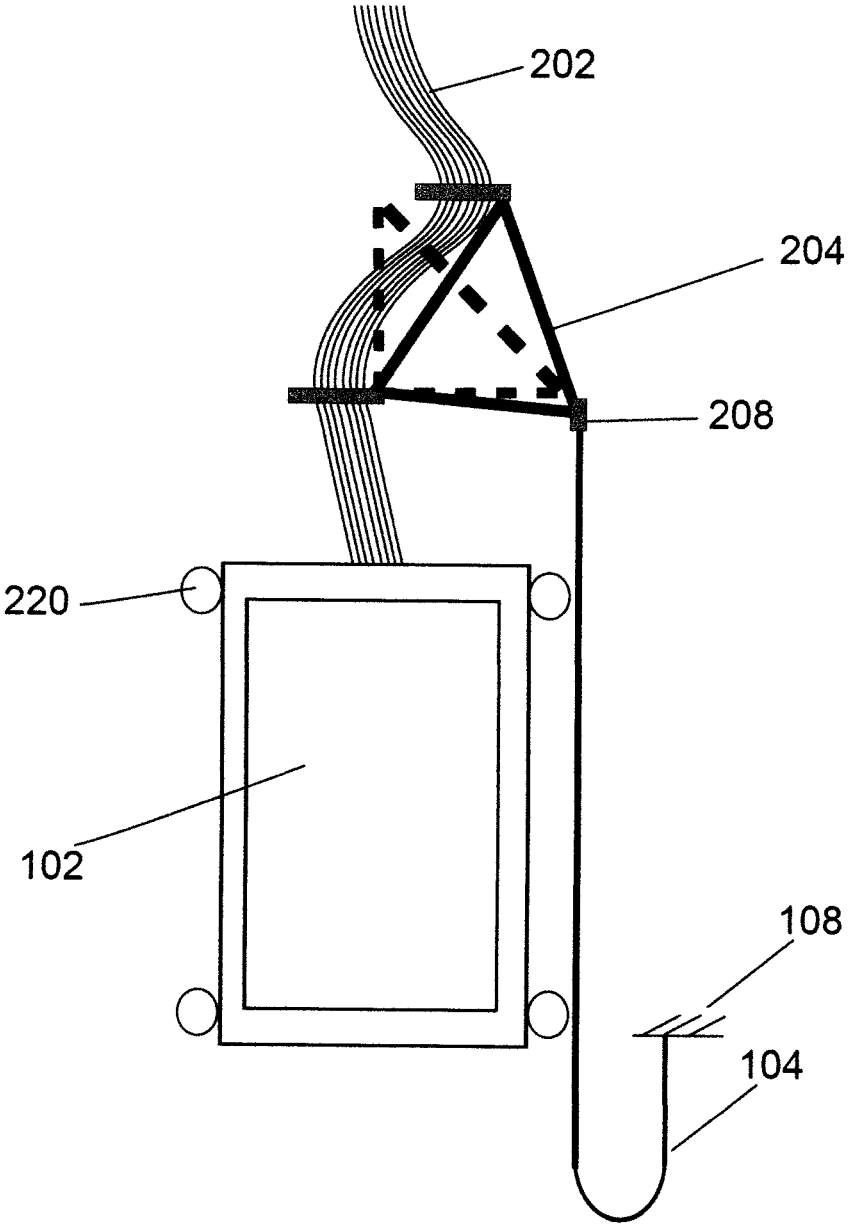
FIG. 1*b* is a schematic side view of the lift system of FIG. 1, wherein the lift car is represented in a second position inside the lift shaft.

FIGS. 1*a* and 1*b* schematically depict a first embodiment of a lift system 100 according to the invention with a support structure 204 for a travelling cable 104. A lift car 102 here can ride in a lift shaft 120, shown schematically. The lift car has a traction means 202 comprising a plurality of traction cables. The lift car 102 is configured with guide rollers 220, which can travel along a guide mechanism (not shown), such as corresponding guide rails. The support structure 204 in this embodiment is configured as a support triangle, which connects the traction means 202 to the travelling cable 104. The support triangle 204 is connected at two corners 204*a* and 204*b* to the traction means 202. The travelling cable 104 is connected, by a suspension member 208, to another corner 204*c* of the support triangle. In this way, the support triangle 204 channels the weight force of the travelling cable 104 into the traction means 202. Since the traction means 202 engages centrally with the lift car 102 or the safety frame (not shown) of the lift car, and the weight force of the travelling cable 104 is channelled above the lift car into the traction means 202, the torque exerted on the lift car by the travelling cable 104, or the force of its weight, is significantly reduced. There is no need for an equalizing weight engaging with the lift car or an asymmetrical balance rope tensioning structure as is known in the prior art. In particular, this minimizes the load on the guide rollers 220.

In FIG. 1*a*, the lift car 102 is located, e.g., in a lower position in the lift shaft 120. Therefore, the weight force of the travelling cable 104 acts almost exclusively on its suspension mount 108 disposed at the shaft side. The load on the support triangle 204 is minimal in this position. Since no counterweight is fashioned on the lift car, no torque is are acting on either the lift car 102 or the guide rollers 220.

In FIG. 1*b* the lift car 102 is located in a middle or upper position in the lift shaft 120. Therefore, the weight force of the travelling cable 104 acts in large measure on the suspension member 208, which is arranged at the corner 204*c* of the support triangle 204. The weight force is channelled by the support triangle 204 into the traction means 202, so that in this position as well the torques caused by the travelling cable on the lift car 102 and the guide rollers 220 are significantly reduced.

Thanks to the one-sided suspension of the travelling cable by the support triangle 204 in relation to the traction means 202, there is a slight inclination of the support triangle 204 and a correspondingly offset or buckled course of the traction means (shown exaggerated as a curve in FIG. 1*b* for reasons of clarity).

Figure 2:
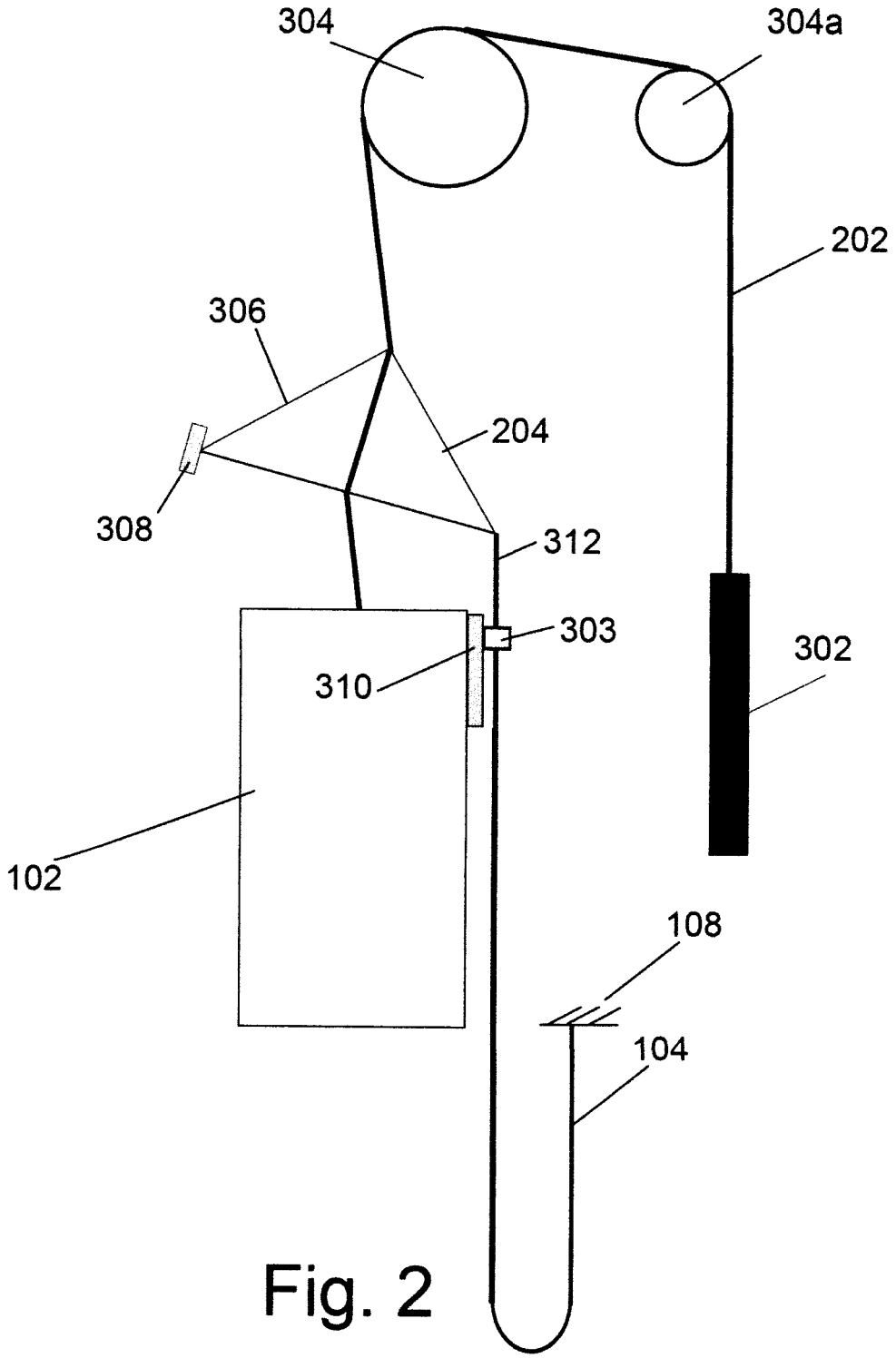
FIG. 2 is a schematic side view of an alternate embodiment of a lift system of the present disclosure.

FIG. 2 shows schematically an alternate embodiment of a lift system according to the present disclosure.

The lift car 102 is suspended from the traction means 202 (for example, traction cables). The traction means 202 is led across a driving sheave 304 (and optionally at least one deflection roller 304*a*) and connected to a counterweight 302.

The end of the travelling cable 104 disposed at the side of the lift car is arranged on a travelling cable suspension member 303, which is configured at the side of the lift car 102.

The travelling cable suspension member 303 is connected to a slide 310 which can move vertically in a guide (not shown) on the lift car 102. The travelling cable suspension member 303 thanks to the vertical movability of the slide 310 is decoupled from the lift car 102 in regard to vertical forces. The vertically movable slide 310 serves for the horizontal guidance of the travelling cable 104.

The travelling cable suspension member 303 is connected by means of a connecting mechanism, especially a connecting rod or a connecting rope 312, to the corner 204*c* of the support triangle 204. In what follows, to simplify the representation, each time only one connecting rod shall be discussed. Thus, on the whole, the weight of the travelling cable 104 is channelled via the suspension member 303, the connecting rod 312 and the support triangle 204 into the traction means 202. A direct connection of the travelling cable suspension member together with the slide to the support triangle 204 is likewise possible.

In FIG. 2, a balancing weight 308 is connected to the support triangle 204. This balancing weight serves to minimize the buckled course of the traction means 202 on account of the weight force of the travelling cable 104 being channelled across the support triangle 204. In the present sample embodiment, the balancing weight 308 is arranged on a rod structure 306. Thanks to the balancing weight, the buckling effect in the traction means 202 can be reduced and the positive effect of the force reduction on the roller guidance is improved.

Figure 3:
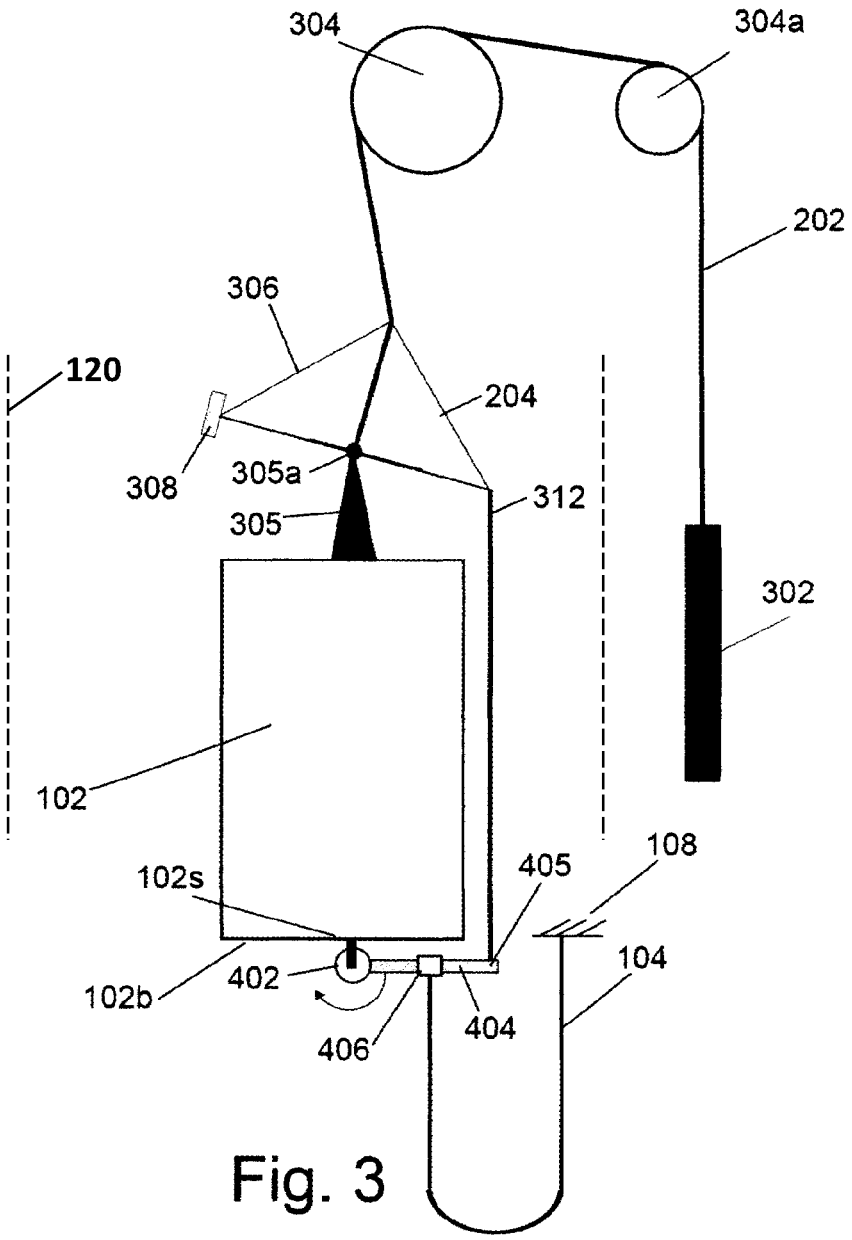
FIG. 3 is a schematic side view of yet another an alternate embodiment of a lift system of the present disclosure.

FIG. 3 shows schematically a lift system according to the invention with another configuration of the travelling cable suspension member. In contrast with the embodiment of FIGS. 1 and 2, the support triangle 204 here is placed pivoting on the lift car or its safety frame, as will be explained below:

On the top of the lift car 102 is provided a mount 305, which has a pivot joint 305*a* at its upper end, to which the support triangle 204 is fastened. The mount can also be configured as part of the safety frame. The support triangle 304 is thus able to pivot about a (horizontal axis) relative to the lift car 102. It should be noted that the mount 305 for reasons of clarity has a certain vertical dimension. It is likewise possible to design this mount very short, or also to provide the pivot joint 305*a* directly on the top side of the lift car or its safety frame.

On the underside 102*b* of the lift car 102 in a central region 102*s*, a pivoting lever 404 is pivotably or hingedly mounted at a first fixed end to a suspension bracket 402. The travelling cable 104 is suspended from the lever 404 by means of a travelling cable suspension member 406.

The other end 405, or opposing free end, of the lever 404 is coupled to a connecting rod 312, which connects the lever 404 to the support triangle 204. Because of the pivoting mounting of the lever 404 and the channelling of the weight force of the traction means across the connecting rod 312 into the support triangle, this embodiment also ensures a reduction of the torque acting on the lift car by virtue of the weight force of the travelling cable.

According to this embodiment, depending on the positioning of the suspension bracket 402, a portion of the weight force of the travelling cable 104 is channelled into the lift car 102. Thanks to the fastening of the pivoting lever 404 in the central region 102*s*, this portion of the weight force of the travelling cable 104 is already channelled centrally into the lift car 102. Thus, here as well, there is a reduced torque on the lift car 102 from the weight force of the travelling cable 104.

Figure 4:
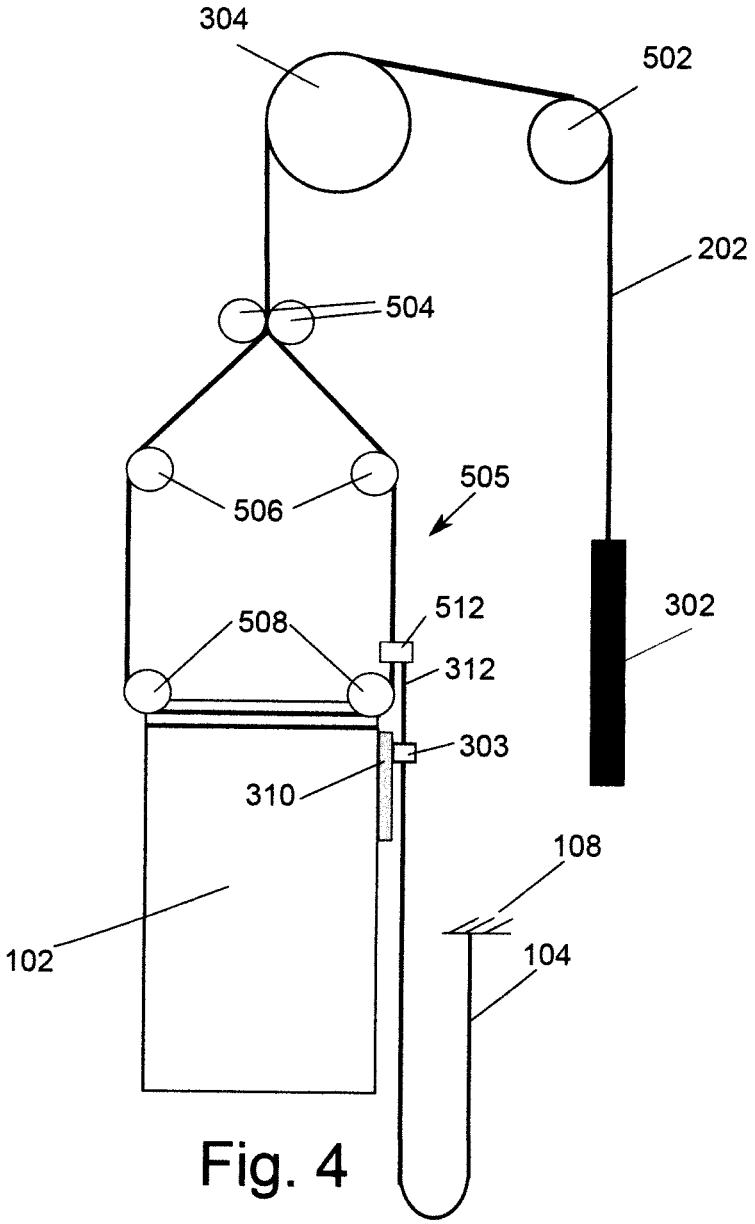
FIG. 4 is a schematic side view of still another an alternate embodiment of a lift system of the present disclosure.

FIG. 4 shows schematically another preferred embodiment of a lift system according to the invention.

The lift system has a lift car 102, which is connected via a traction means 202 to a counterweight 302. Both ends of the traction means 202 here are fastened to the counterweight. This means that the traction means is led across corresponding deflection rollers 502, 504, 506 and 508 as well as a driving sheave 304 from the counterweight to the lift car 102 and back again to the counterweight 302. The lift car here is suspended from a loop formed by the traction means 202. The deflection rollers 508 here are fashioned on the lift car. The other deflection rollers 502, 504, 506 as well as the driving sheave 304 are suspended or mounted for example in the shaft and/or in a machine room.

The travelling cable 104, similar to the embodiment of FIG. 2, is connected by means of a suspension member 303 to a vertically movable slide 310. Here as well, one connecting rod 312 is provided. This connecting rod 312 connects the suspension member 303 to a fastening element 512 formed on the traction means. Thanks to this design, similar to the embodiment of FIG. 2, on the one hand the travelling cable suspension member 303 is vertically force-decoupled from the lift car. On the other hand, the weight force of the travelling cable is channelled across the connecting rod 312 and the fastening element 512 into the traction means. Thanks to the suspension of the lift car 102 by the two deflection rollers 508, the lift car is essentially decoupled from the weight of the travelling cable. Therefore also with this embodiment there is no torque acting on the lift car 102 due to the weight force of the travelling cable.

The guidance of the traction means in FIG. 4 can also be combined with the suspension of the travelling cable according to FIG. 3. In this case, for example, the fastening element 512 as shown in FIG. 4 can be connected by a rope or a rod to a pivoting lever mounted underneath the lift car 102, as is shown in FIG. 3.

Figure 5:
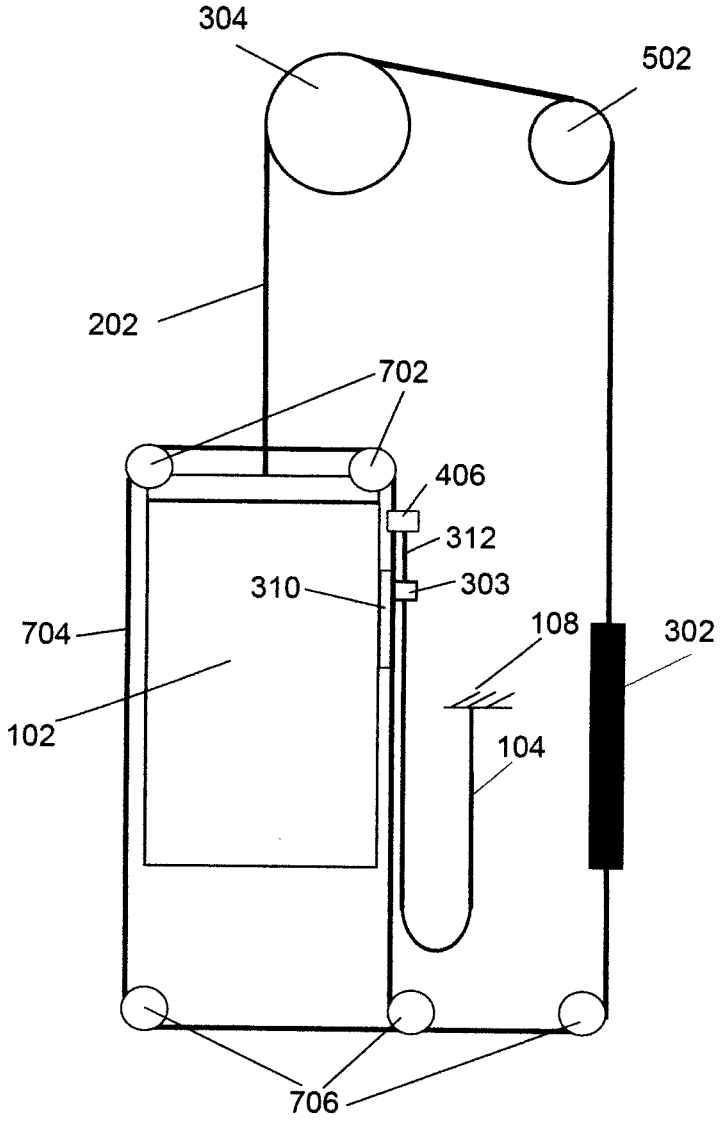
FIG. 5 is a schematic side view of an additional alternate embodiment of a lift system of the present disclosure.

FIG. 5 shows schematically another embodiment of a lift system according to the invention.

According to this embodiment, a lift car 102 is connected via a traction means, which is led across a driving sheave 304 and at least one deflection roller 502, to a counterweight 302.

In addition, this lift system has a balance rope 704, which is fastened at its two ends to the underside of the counterweight 302. The balance rope 704 is led across (schematically depicted) deflection rollers 706 provided in the bottom of the shaft and deflection rollers 702 provided on the top side of the lift car 102 from the counterweight 302 across the lift car 102 and back to the counterweight. The deflection rollers 706 can also be configured with a balance rope tensioning device (not shown).

Once again, a travelling cable 104 is provided, which has an end 108 at the shaft side and an end at the lift car side, which is fastened to a travelling cable suspension member 303. The travelling cable suspension member 303 as in the embodiment of FIG. 2 is arranged on a slide 310 which can move vertically on the lift car wall.

The travelling cable suspension member 303 according to this embodiment is connected by a connecting rod 312 to a fastening element 406 arranged on the balance rope. Thus, the weight force of the travelling cable 104 will be channelled into the balance rope 704.

At the same time in this embodiment there is a vertical force decoupling of the travelling cable suspension member 303 from the lift car thanks to the vertical movability of the travelling cable suspension member 303 via the slide 310.

The configuration for decoupling of the suspension of the travelling cable relative to the lift car according to FIG. 3 (i.e., with a pivoting lever provided on the underside of the lift car, to which the travelling cable 104 is fastened) can also be combined with the balance rope structure according to FIG. 5. For this, it is only necessary to connect the outer end of such a pivoting lever across a corresponding connecting rod to the balance rope (for example, making use of a corresponding fastening element).

LIST OF REFERENCE SYMBOLS

100 Lift system
102 Lift car
102*b* Underside of the lift car
102*s* Middle region of the underside of the lift car
104 Travelling cable
108 Shaft-side suspension mount of the travelling cable
120 Shaft
202 Traction means (traction cable)
204 Support structure (support triangle)
204*a* Corner of the support triangle
204*b* Corner of the support triangle
204*c* Corner of the support triangle
208 Suspension member coupled to the travelling cable
220 Guide rollers
302 Counterweight
303 Travelling cable suspension member
304 Driving sheave
304*a* Deflection roller
305 Mount
305*a* Pivot joint
306 Rod structure
308 Balancing weight
310 Slide
312 Connecting mechanism, connecting element (connecting rod, connecting rope)
402 Suspension bracket (pivoting)
404 Lever
405 End of lever
406 Travelling cable suspension member
502 Deflection rollers
504 Deflection rollers
506 Deflection rollers
508 Suspension of lift car (deflection rollers)
512 Fastening element
702 Suspension/guidance of balance rope on lift car (deflection rollers)
704 Balancing means (balance rope)
706 Deflection rollers

What is claimed is:

1. A lift system comprising:

at least one lift car configured to ride in a lift shaft;

a traction means coupled to a top of the lift car and configured to support said lift car in the lift shaft; and a traveling cable having a first end disposed at a side or an underside of said lift car and coupled to said traction means above said lift car, and a second end disposed at a side of said lift shaft, a weight force of said traveling cable being at least partially supported by said traction means above said lift car, wherein at least a portion of the weight force of the traveling cable that is supported by the traction means is channeled around the at least one lift car.

2. The lift system of claim 1, wherein said traction means is a traction cable of said lift car.

3. The lift system of claim 1, further comprising:

a support structure affixed to said traction means above said lift car, and further coupled to said traveling cable, said support structure configured to support the weight force of said traveling cable.

4. The lift system of claim 3, further comprising a balancing weight disposed on said support structure and configured to at least partially balance out a torque applied to said traction means by said weight force of said traveling cable acting on said support structure affixed to said traction means.

5. The lift system of claim 3, wherein said support structure is coupled at a first location thereof to said traction means, and is coupled at a second location thereof to said traveling cable.

6. The lift system of claim 3, wherein said support structure is pivotably mounted to said lift car.

7. The lift system of claim 3, further comprising:

a slide member coupled to a side of the lift car; and a suspension member coupled to and vertically slidable in said slide member, and coupled to said first end of said traveling cable, so as to permit said first end of said traveling cable to slide vertically with respect to said lift car; and a connecting mechanism coupled at a first end thereof to said suspension member and at a second end thereof to said support structure.

8. The lift system of claim 3, further comprising:

a pivoting lever pivotably mounted at a fixed end to said lift car, and further mounted to said travelling cable at a location distal from said fixed end; and a connecting element coupled between each of a free end of said pivoting lever and said support structure, and configured to transmit at least a portion of said weight force from said traveling cable to said support structure.

9. The lift system of claim 1, further comprising:

a balance rope coupled to said lift car, and configured to serve as a balancing means for said lift car and support at least a portion of said weight force of said traveling cable.

10. The lift system of claim 9, further comprising:

a slide member coupled to a side of the lift car; and a suspension member coupled to and vertically slidable in said slide member, and coupled to said first end of said traveling cable, so as to permit said first end of said traveling cable to slide vertically with respect to said lift car;

a connecting element coupled between each of said suspension member and one of said balance rope or a support structure that is coupled to said balance rope.

11. The lift system of claim 9, further comprising:

a pivoting lever pivotably mounted at a fixed end to said lift car, and further mounted to said travelling cable at a location distal from said fixed end; and a connecting element coupled between each of a free end of said pivoting lever and said balance rope, and configured to transmit at least a portion of said weight force from said traveling cable to said balance rope.

12. The lift system of claim 1, further comprising:

a plurality of guide rollers coupled to said lift car; and a guide mechanism disposed in the lift shaft, and configured to permit said guide rollers of said lift car to ride there along.

13. The lift system of claim 1, further comprising:

at least one guide mechanism disposed in the lift shaft;

a non-contact magnetic guidance mechanism disposed on said lift car that is configured to permit said lift car to ride along said guide mechanism without said lift car contacting said guide mechanism.

14. A lift system comprising:

at least one lift car configured to ride in a lift shaft;

a traction means coupled to a top of the lift car and configured to support said lift car in the lift shaft;

a balancing means coupled to said lift car; and a traveling cable having a first end disposed at a side or an underside of said lift car and coupled to said balancing means, and a second end disposed at a side of said lift shaft, a weight force of said traveling cable being at least partially supported by said balancing means, wherein at least a portion of the weight force of the traveling cable that is supported by the balancing means is channeled around the at least one lift car.

* * * * *